United States Patent [19]

Jansen

[11] Patent Number: 4,681,536

[45] Date of Patent: Jul. 21, 1987

[54] CHARGING SLUICE FOR ANNEALING OVEN

[75] Inventor: Rudolf Jansen, Monschau, Fed. Rep. of Germany

[73] Assignee: Otto Junker GmbH, Simmerath, Fed. Rep. of Germany

[21] Appl. No.: 765,874

[22] Filed: Aug. 14, 1985

[30] Foreign Application Priority Data

Aug. 17, 1984 [DE] Fed. Rep. of Germany ..... 3430205

[51] Int. Cl.[4] ..... F27B 9/28; F26B 25/12

[52] U.S. Cl. ..... 432/59; 432/242; 34/242

[58] Field of Search ..... 432/59, 242; 34/242; 266/102, 103

[56] References Cited

U.S. PATENT DOCUMENTS 3,460,359 8/1969 Schiffer ..... 34/242
4,268,977 5/1981 Geiger ..... 432/242

FOREIGN PATENT DOCUMENTS 1149374 5/1963 Fed. Rep. of Germany .

*Primary Examiner*—Henry C. Yuen
*Attorney, Agent, or Firm*—Michael J. Striker

[57] ABSTRACT

A sluice for feeding a continually transported material to be annealed into an annealing oven includes two opposing sealing hollow plates spaced from each other to permit the material to pass therebetween and each provided with a coating of ceramic felt. A conduit for feeding buffer gas into the space between two opposing plates opens into that space to fill that space with buffer gas and to prevent oxygen from entering the oven.

9 Claims, 2 Drawing Figures

CHARGING SLUICE FOR ANNEALING OVEN

BACKGROUND OF THE INVENTION

The present invention relates to a sluice for feeding a material to be annealed into an annealing oven, more particularly for feeding a metallic tape which is continually fed into the internal space of the oven, wherein a buffer gas atmosphere is maintained in the oven and a sealing device should be provided before the entrance opening of the oven to protect the oven interior from ambient air.

It has been known that when metal material, for example a metal tape is to be annealed in the oven a buffer gas atmosphere should be produced in the annealing oven to prevent oxidation on the outer surface of the metal material. Such a buffer gas atmosphere can be also preferably provided at the cooling line. While the piece goods in the oven interior after the material being annealed has entered the oven, can be sealed without any problems, maintanence of a pipe buffer gas atmosphere during the transportation of the material being annealed, for example a metallic tape, still presents a problem.

Tests have shown that in order to solve the above described problems with the annealing ovens for tape-shaped metal materials a water tank has been provided in connection with the oven or the cooling line; the metal tape discharged from the oven was immersed into that tank and then after being reoriented in the water bath was transported to ambient atmosphere. Such water sealings have been, however, suitable only for flexible materials being annealed. Such water sealing can not be in practice arranged at the inlet of the oven because of an unavoidable strong steam generation in the oven interior. Steam affects the quality of the buffer gas atmosphere such that shadings or discoloration can occur on the material being annealed.

Sealing devices formed as a sluice have been known. One of them is disclosed, for example in DE-AS No. 1,149,374. Tubular elements are provided in the known device at the inlet side and the outlet side of the oven, in which tubular elements the end portions are adjusted in cross-section to that of the material being annealed. Due to the adjustment of the cross-section of each through opening in the sealing devices to the cross-section of the material being fed into the oven only small amounts of buffer or protective gas can escape from the oven. As a further means to solve the problem, a buffer gas has been fed through the oven in counter stream to the direction of transportation of the material being annealed. However, still some amounts of buffer gas escaped from the oven and too much oxygen entered the oven whereby it was impossible to completely prevent oxidation of the metal being annealed. Relatively narrow but suitable permeable sealing devices have been found specifically problematic in practice when, for example the end portions of the two metallic tapes being annealed were stitched together to avoid the interruption of operation of the oven. These superpositioned ends of two metallic tapes overlap only in a small region. If the inlet and outlet openings of the oven have a narrow cross-section adjusted to the cross-section of the single metallic tape they are too narrow to pass therethrough the tape end portions having a double tape thickness. In practice the feeding process of the metal tapes can be interrupted or the inlet and outlet openings can be dimensioned to permit passing therethrough of the overlapping portions of the tapes. However, the enlargement of these openings leads to more oxygen entering the oven interior.

SUMMARY OF THE INVENTION

It is an object of the present invention to provide an improved charging sluice for feeding a metallic tape into an annealing oven.

It is another object of this invention to provide a sluice which would prevent oxygen from entering the oven interior.

These and other objects of the invention are attained by a sluice for an annealing oven for feeding a material to be annealed, particularly a metallic tape, continually transported in the sluice, into an interior of the oven wherein a buffer gas atmosphere is maintained, comprising a sealing device positioned before an inlet opening of the oven, said sealing device including two sealing members spaced from each other to form a space through which said material is continually transported, said sealing members being adjustable relative to each other in the direction normal to the direction of transportation of said material.

By adjusting the positions of the sealing members in the direction perpendicular to the direction of transportation of the material being fed into the oven an optimal adjustment to the cross-section of the material being fed is ensured. If two ends of two successive metallic tapes are connected to each other with partial overlapping both sealing members would be moved away from each other for a short period of time to permit the overlapping region to pass through the space between the sealing members. A normal operation then takes place.

The sluice of the present invention provides such a sealed closing of the interior of the oven that the material being treated has oxidation-free smooth surfaces when it leaves the oven or the cooling line connected to the oven. The aforementioned short movement of the two sealing members away from each other can be controlled by light switches which are known for such a purpose.

Preferably the sealing members may be formed as thin-walled hollow plates. The opposing sides of the sealing plates lie very close to the other sides of the material to be annealed. If the hollow plates are formed of thin-wall strips they extend transversally of the transport direction.

The side of each of said plates, facing a material being fed, may have a coating of ceramic felt. Ceramic felt is known and has good mechanical and particularly thermal properties. Since felt is relatively elastic the plates coated with ceramic felt can sealingly guide the material being treated without damaging the latter.

Inasmuch as a relatively high heating effect is obtained on the sealing members according to the invention the sluice may include cooling channels each positioned between a respective sealing member and a housing of the oven.

Each cooling channel may be positioned at a side of the assigned plate, facing away from the material being fed. The cooling channels may be formed, for example as metal boxes which can also serve as supports for ceramic felt.

A particularly good sealing is obtained when the coating on each plate is wave-shaped in said direction of transportation.

The coating may be also of ribbed structure.

The wave-shaped coatings of the two plates, opposing each other may be symmetrical relative to a plane of elongation of said material. This material passes through the narrower regions and a widened region between two opposing wave-shaped coatings. At the central widened region a conduit for feeding a buffer gas can open into the sluice. By the wave-shaped or ribbed structure of each coating the buffer gas can be maintained in that central region to prevent oxygen from entering the oven.

As additional cooling channel can be provided between the sluice and the front wall of the oven.

In order to be able to attach the sluice either to the inlet of the oven or the outlet thereof the sealing members may be formed as a support structure which is mounted right before an oven opening.

The sluice may further include means for adjusting the position of each plate, said means including two pneumatic cylinders each connected to the assigned plate to move the latter in the direction normal to the direction of transportation. The control of both cylinders can be carried out such that a symmetrical position of both sealing plates relative to the transportation plane of the material being treated would be always ensured.

Since ceramic felt is subject to mechanical and thermal wear each coating must be interchangeable. Therefore each coating may be connected to the assigned plate by releasable clamping means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
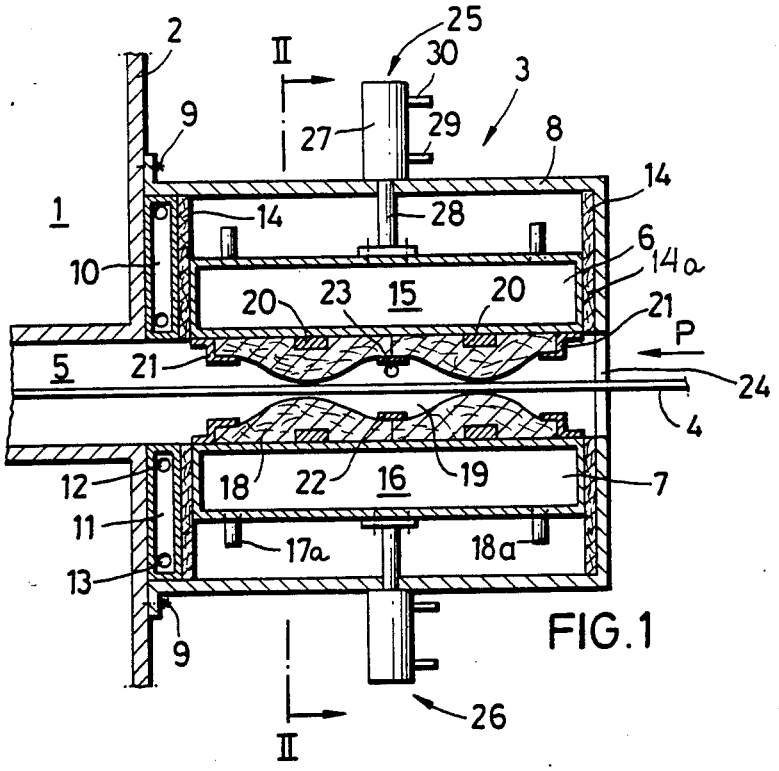
FIG. 1 is a schematic sectional view of a sluice arranged at the entrance of the annealing oven.

Referring now to the drawings in detail it will be seen that reference numeral 1 designates an annealing oven 1 having a housing 2. At the inlet opening for a material being annealed of the housing 2, is arranged a sluice 3 through which a material being annealed, in the present case a metal strip or tape 4, drawn from a non-illustrated supply roll, is transported in the direction of arrow P into the oven interior space 5.

An atmosphere of a protective or buffer gas is maintained in the oven internal space 5, which must prevent the oxidation of the outer surfaces of the metal tape 4. Sluice 3 has the purpose of separating the oven internal space or chamber 5 from the environment air.

Sluice 3 is provided with a sealing device which is comprised of two hollow sealing members formed by plates 6 and 7.

The sealing device is received in a sluice housing 8, which is secured to the housing 2 of the annealing oven by bolts 9. To ensure a thermal sealing cooling passages 10 and 11 are provided between the hollow sealing plates 6 and 7 and the wall of the oven housing 2. Cooling passages 10 and 11 are supplied with cooling water through inlets 12. Water heated up in passages 10 and 12 can leave through outlets 13.

As shown in FIG. 1 the upper half of the sluice, e.g. the half above the metal tape 4 is arranged in mirrow-inverted relationship with the lower half of the sluice.

A further sealing 14 of ceramic felt is provided between each sealing plate 6, 7 and a respective cooling passage 10, 11. Yet another sealing is positioned at the opposite side of the sluice between the end wall of housing 8 of the sluice and each sealing plate 6, 7, respectively.

Sealing plates 6 and 7 each is a hollow metallic element of rectangular cross-section which forms a cooling passage 15 or 16, respectively. A cooling medium, for example cooling water, can be passed through passages 15 and 16. Connections **17*a* and 18*a* for receiving and discharging cooling water are provided in the walls of the sealing plates 6 and 7, facing away from the metal tape 4. Cooling water hoses connected to a non-shown cooling water source and a tank (not-shown), can be attached to connections 17*a* and 18*a***.

Each sealing plate 6, 7 at the side thereof, facing the metal tape 4 is provided with a coating of ceramic material. Each coating 18 has a wave-shaped structure so that two widened end areas and two narrow intermediate areas, as well as a central hollow region 19, are formed between two coatings 18 of plates 6 and 7, facing each other.

Figure 2:
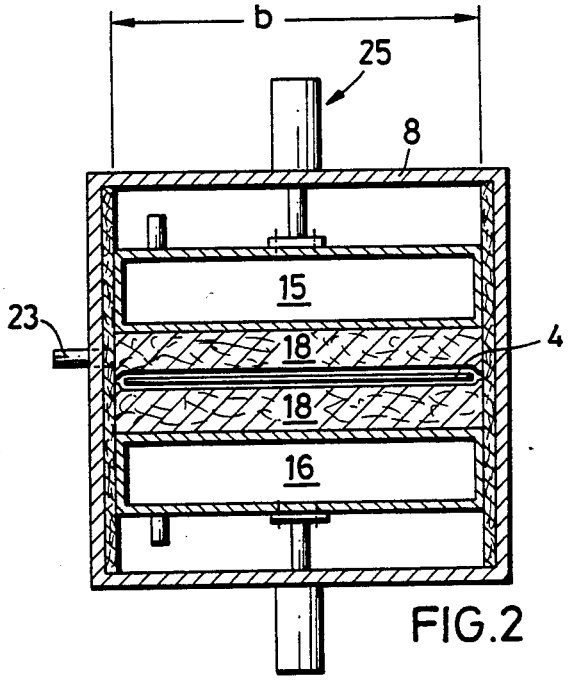
FIG. 2 is a sectional view taken along line II—II of FIG. 1.

In order to produce the wave-shaped structure along the direction of transporting of the metal tape 4, spacing strips 20, for example of metal, are positioned at the sides of the sealing plates 6 and 7, facing each other. Spacing strips 20 are spaced from each other in the direction of arrow P and also extend over the entire width "b" of the sluice (FIG. 2). The spacing strips 20 serve for maintaining the wave-shaped structure of each coating.

The filling coating or lining 18 on each sealing plate 6, 7 is secured to the outer surface of the respective plate by means of lateral clamping strip-shaped elements 21 and central strip-shaped clamping elements 22. Clamping elements 21, 22 can be any suitable conventional clamping strips which can be easily loosened to enable an operator to remove the respective coating or lining 18 without any troubles from the face of the sealing plate 6 or 7 and to install a new felt lining in place of the old one.

In the region of the central hollow space 19, between two opposing linings 18 a buffer gas conduit 23 is provided, which opens into space 19, whereby buffer gas atmosphere 25 is produced in space 19. The buffer gas entering the space 19 is taken along by the moving metal tape 4 and is fed thereby into the oven inner space 5 on the one hand, and, on the other hand, this gas is prevented from escaping outwardly by the right-hand narrow region between the opposing linings 18 of plates 6 and 7 so that the entrance of oxygen into the oven is reliably prevented. Feeling conduits for buffer gas can be also provided in the oven inner space itself.

Sluice 3 has an inlet opening 24 through which the metallic tape 4 to be annealed enters the sluice. Both sealing plates 6 and 7 provided at the opposing walls with the ceramic linings are adjusted relative to the metallic tape 4 so that the opposing linings at their narrow spacings from each other quickly contact the metallic band. This is made possible by schematically illustrated adjustment devices 25 and 26 for adjusting the sealing plates 6 and 7. The adjustment devices 25 and 26 are identical. Each adjustment device includes an air cylinder 27 in which a piston 28 is reciprocated. At the end of the piston 28, remote from cylinder 27, the piston is rigidly secured to the assigned sealing plate. Pressure air is supplied into each cylinder 27, namely into its lower and upper chambers, via pressure air connections 29 and 30 to move the piston up and down and thereby adjust the assigned sealing plate 6, 7 in the plane which is perpendicular to the direction of transportation of metallic tape 4.

As clear from the above description both sealing plates 6 and 7 can be adjusted in the direction normal to the transportation direction of tape 4 so that an optimal sealing between the oven interior 5 and the atmosphere is obtained.

The present invention is not limited to the exemplified embodiments. The hollow sealing plates 6 and 7 can be made as solid plates. It is also not necessary that sealing plates 6 and 7 be adjustable. It is also possible that one of the sealing plates be stationary while the other one be adjustable.

The wave-shaped felt lining 18 can alternatively have a smooth outer face whereby each lining would have the same thickness over the entire cross-section. Ribs may be provided on the outer face of each lining in place of the wave-shaped structure. These ribs may be formed as strips of ceramic felt applied to the linings coating the faces of the sealing plates.

It will be understood that each of the elements described above, or two or more together, may also find a useful application in other types of charging sluices for annealing ovens differing from the types described above.

While the invention has been illustrated and described as embodied in a charging sluice for an annealing oven, it is not intended to be limited to the details shown, since various modifications and structural changes may be made without departing in any way from the spirit of the present invention.

Without further analysis, the foregoing will so fully reveal the gist of the present invention that others can, by applying current knowledged, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an annealing oven having an interior and an inlet opening and provided with a transporting sluice arrangement for sealing the interior of the oven from outside air and continually feeding a material to be annealed, particularly a metallic tape into the interior of the oven, wherein a buffer atmosphere is maintained, the transporting sluice arrangement comprising a housing attached to the annealing oven; a sealing device positioned in said housing before the inlet opening of the oven, said sealing device including two sealing members spaced from each other to form a space through which said material is continually transported, said sealing members being adjustable relative to each other in the direction normal to the direction of transportation of said material, said sealing members being thin-wall hollow plates, each plate having at a side facing said material a coating of ceramic felt; and means for adjusting the position of each plate, said means including two pneumatic cylinders each connected to the assigned plate to move the latter in the direction normal to the direction of transportation.

2. The sluice as defined in claim 1, wherein each plate has a cooling channel therein, said channel being connected to a source of cooling medium.

3. The sluice as defined in claim 2, wherein each cooling channel is positioned at a side of the assigned plate, facing away from the material being fed.

4. The sluice as defined in claim 1, wherein said coating is wave-shaped in said direction of transportation.

5. The sluice as defined in claim 4, wherein the wave-shaped coatings of two plates, opposing each other, are symmetrical relative to a plane of elongation of said material.

6. The sluice as defined in claim 1, further including a conduit for feeding buffer gas, said conduit opening into a space formed between two opposing coatings.

7. The sluice as defined in claim 1, further including cooling channels each positioned between a respective sealing member and the oven.

8. The sluice as defined in claim 1, wherein said sealing members are formed as a support structure which is mounted before said inlet opening.

9. The sluice as defined in claim 1, wherein each coating is connected to the assigned plate by releasable clamping means.

* * * * *